US008615097B2

(12) United States Patent
Parker et al.

(10) Patent No.: US 8,615,097 B2
(45) Date of Patent: Dec. 24, 2013

(54) WAVEGUIDE ELECTROACOUSTICAL TRANSDUCING

(71) Applicants: Robert Preston Parker, Westborough, MA (US); Eric J. Freeman, Sutton, MA (US); Jeffrey J. Hoefler, Westwood, MA (US)

(72) Inventors: Robert Preston Parker, Westborough, MA (US); Eric J. Freeman, Sutton, MA (US); Jeffrey J. Hoefler, Westwood, MA (US)

(73) Assignee: Bose Corportion, Framingham, MA (US)

( * ) Notice: Subject to any disclaimer, the term of this patent is extended or adjusted under 35 U.S.C. 154(b) by 0 days.

(21) Appl. No.: 13/630,319

(22) Filed: Sep. 28, 2012

(65) Prior Publication Data

US 2013/0034255 A1 Feb. 7, 2013

Related U.S. Application Data

(63) Continuation-in-part of application No. 12/020,978, filed on Feb. 21, 2008, now Pat. No. 8,351,629.

(51) Int. Cl.
*H04R 25/00* (2006.01)

(52) U.S. Cl.
USPC ..... 381/338; 381/337; 381/339; 381/341

(58) Field of Classification Search
USPC ..... 381/337–344, 348–349; 181/22, 181/175–179
See application file for complete search history.

(56) References Cited

U.S. PATENT DOCUMENTS

| | | | |
|---|---|---|---|
| 1,387,490 | A | 8/1921 | Humes |
| 2,225,312 | A | 12/1940 | Mason |
| 2,318,535 | A | 5/1943 | Spivak |
| 2,566,094 | A | 8/1951 | Olson et al. |
| 2,739,659 | A | 3/1956 | Daniels |
| 2,789,651 | A | 4/1957 | Daniels |
| 2,913,680 | A | 11/1959 | Porter et al. |
| 2,939,922 | A | 6/1960 | Gorike |
| 3,381,773 | A | 5/1968 | Schenkel |
| 3,517,390 | A | 6/1970 | Whitehead |
| 3,555,956 | A | 1/1971 | Martin |
| 3,657,490 | A | 4/1972 | Scheiber |
| 3,930,560 | A | 1/1976 | Carlson et al. |
| 3,978,941 | A | 9/1976 | Siebert |

(Continued)

FOREIGN PATENT DOCUMENTS

| | | | |
|---|---|---|---|
| EP | 0608937 | A1 | 8/1994 |
| EP | 1921890 | A2 | 5/2008 |
| WO | 2009105313 | A1 | 8/2009 |
| WO | 2009134591 | A1 | 11/2009 |

OTHER PUBLICATIONS

International Preliminary Report on Patentability dated Feb. 21, 2013 for PCT/US2011/047429.

(Continued)

*Primary Examiner* — Suhan Ni
(74) *Attorney, Agent, or Firm* — Bose Corporation

(57) ABSTRACT

A loudspeaker assembly, including an acoustic waveguide; an acoustic driver mounted in the waveguide so that a first surface radiates sound waves into the waveguide so that the sound waves are radiated from the waveguide; and an acoustic volume acoustically coupled to the acoustic waveguide for increasing the amplitude of the sound waves radiated from the acoustic waveguide.

20 Claims, 16 Drawing Sheets

(56) References Cited

U.S. PATENT DOCUMENTS

| | | | |
|---|---|---|---|
| 4,251,686 | A | 2/1981 | Sokolich |
| 4,297,538 | A | 10/1981 | Massa |
| 4,340,787 | A | 7/1982 | Gorike |
| 4,421,957 | A | 12/1983 | Wallace, Jr. |
| 4,546,459 | A | 10/1985 | Congdon |
| 4,586,194 | A | 4/1986 | Kohashi et al. |
| 4,628,528 | A | 12/1986 | Bose et al. |
| 4,646,872 | A | 3/1987 | Kamon et al. |
| 4,942,939 | A | 7/1990 | Harrison |
| 5,022,486 | A | 6/1991 | Miura et al. |
| 5,137,110 | A | 8/1992 | Bedard, Jr. et al. |
| 5,170,435 | A | 12/1992 | Rosen et al. |
| 5,187,333 | A | 2/1993 | Adair |
| 5,197,103 | A | 3/1993 | Hayakawa |
| 5,261,006 | A | 11/1993 | Nieuwendijk et al. |
| 5,276,740 | A | 1/1994 | Inanaga et al. |
| 5,325,435 | A | 6/1994 | Date et al. |
| 5,854,450 | A | 12/1998 | Kent |
| 6,005,952 | A | 12/1999 | Klippel |
| 6,075,868 | A | 6/2000 | Goldfarb et al. |
| 6,411,718 | B1 | 6/2002 | Danley et al. |
| 6,771,787 | B1 | 8/2004 | Hoefler et al. |
| 7,426,280 | B2 | 9/2008 | Aylward |
| 7,536,024 | B2 | 5/2009 | Bailey et al. |
| 7,747,033 | B2 | 6/2010 | Uchimura |
| 7,751,582 | B2 | 7/2010 | Akino |
| D621,439 | S | 8/2010 | Hamanaga |
| 7,826,633 | B2 | 11/2010 | Davi |
| 7,833,282 | B2 | 11/2010 | Mandpe |
| 7,835,537 | B2 | 11/2010 | Cheney |
| 7,848,535 | B2 | 12/2010 | Akino |
| 8,066,095 | B1 | 11/2011 | Bromer |
| 8,175,311 | B2 | 5/2012 | Aylward |
| 8,351,630 | B2 | 1/2013 | Ickler et al. |
| 2003/0095672 | A1 | 5/2003 | Hobelsberger |
| 2003/0164820 | A1 | 9/2003 | Kent |
| 2004/0105559 | A1 | 6/2004 | Aylward et al. |
| 2005/0013457 | A1 | 1/2005 | Sheplak et al. |
| 2005/0205348 | A1 | 9/2005 | Parker et al. |
| 2005/0205349 | A1 | 9/2005 | Parker et al. |
| 2005/0254681 | A1 | 11/2005 | Bailey et al. |
| 2006/0274913 | A1 | 12/2006 | Akino |
| 2006/0285714 | A1 | 12/2006 | Akino |
| 2007/0086606 | A1 | 4/2007 | Goodwin |
| 2007/0233036 | A1 | 10/2007 | Mandpe |
| 2007/0286427 | A1 | 12/2007 | Jung et al. |
| 2009/0003613 | A1 | 1/2009 | Christensen |
| 2009/0003639 | A1 | 1/2009 | Aylward |
| 2009/0016555 | A1 | 1/2009 | Lynnworth |
| 2009/0208047 | A1 | 8/2009 | Ngia et al. |
| 2009/0209304 | A1 | 8/2009 | Ngia et al. |
| 2009/0226004 | A1 | 9/2009 | Sorensen |
| 2009/0274313 | A1 | 11/2009 | Klein et al. |
| 2009/0323995 | A1 | 12/2009 | Sibbald |
| 2010/0092019 | A1 | 4/2010 | Hoefler et al. |
| 2010/0224441 | A1 | 9/2010 | Fujimori et al. |
| 2010/0290630 | A1 | 11/2010 | Berardi et al. |
| 2011/0026744 | A1 | 2/2011 | Jankovsky et al. |
| 2011/0028986 | A1 | 2/2011 | Mandpe |
| 2011/0096950 | A1 | 4/2011 | Rougas et al. |
| 2011/0206228 | A1 | 8/2011 | Shiozawa et al. |
| 2011/0219936 | A1 | 9/2011 | Masuda et al. |
| 2011/0305359 | A1 | 12/2011 | Ikeda et al. |
| 2012/0039475 | A1 | 2/2012 | Berardi et al. |
| 2012/0057736 | A1 | 3/2012 | Shiozawa et al. |
| 2012/0121118 | A1 | 5/2012 | Fregoso et al. |

OTHER PUBLICATIONS

International Search Report and Written Opinion dated Nov. 2, 2011 for PCT/US2011/047429.

English Translation of Abstract for JP Patent 336975, published Nov. 24, 1992.

First Chinese Office Action dated Dec. 31, 2012 for Chinese Patent Application No. 200980114910.X.

WAVEGUIDE ELECTROACOUSTICAL TRANSDUCING

CROSS-REFERENCE TO RELATED APPLICATIONS

This application is a continuation-in-part of, and claims priority of, U.S. patent application Ser. No. 12/020,978, published as U.S. Published Pat. App. 2009/214066 A1, now U.S. Pat. No. 8,351,629.

BACKGROUND

This specification describes an improved acoustic waveguide. Acoustic waveguides are described generally in U.S. Pat. No. 4,628,528. Some specific aspects of acoustic waveguides are described in U.S. Pat. No. 6,771,787 and in U.S. patent application Ser. No. 09/753,167.

SUMMARY

In one aspect, a loudspeaker assembly, comprises: an acoustic waveguide; an acoustic driver mounted in the waveguide so that a first surface radiates sound waves into the waveguide so that the sound waves are radiated from the waveguide; and an acoustic volume acoustically coupled to the acoustic waveguide for increasing the amplitude of the sound waves radiated from the acoustic waveguide. The acoustic waveguide may be substantially lossless. The acoustic volume may be for increasing the amplitude of sound waves of a wavelength equal to the effective acoustic length of the waveguide. The acoustic waveguide may have curved walls forming walls of the acoustic volume. The acoustic waveguide may have curved walls forming walls of an acoustic volume acoustically coupled to the acoustic waveguide to increase the acoustic radiation from the waveguide. The acoustic volume may be tear drop shaped. The waveguide walls may form walls of another acoustic volume coupled to the acoustic waveguide. The loudspeaker assembly may further comprise electronic components positioned in the acoustic volume. The loudspeaker assembly may further comprise a coupling volume for acoustically coupling the acoustic waveguide to the acoustic volume and the combination of the coupling volume and the acoustic volume may form a Helmholtz resonator may have a Helmholtz resonance frequency that is outside the operating range of the loudspeaker assembly. The acoustic driver may be mounted so that a second surface of the acoustic driver radiates directly to the environment. The waveguide may comprise multiple curved sections substantially defining the acoustic volume. The acoustic waveguide may substantially define another acoustic volume. The acoustic volume may be teardrop shaped. The waveguide may have an effective acoustic length, and the acoustic volume may have acoustic paths each having a length that is less than 10% of the effective acoustic length of the loudspeaker assembly, or the acoustic paths may have a length that is greater than 10% of the effective acoustic length of the loudspeaker assembly and that is within a range of lengths that does not result in a dip in a frequency response. The acoustic volume may comprise a baffle structure causing the length of an acoustic path to be within the range of lengths. The waveguide may have a substantially constant cross-sectional area. A closed end of the waveguide adjacent the acoustic driver may have a larger cross-sectional area than an open end of the waveguide.

In another aspect, a loudspeaker assembly, comprises: an acoustic driver; an acoustic waveguide with substantially continuous walls acoustically coupled to the acoustic driver so that a first surface of the acoustic driver radiates into the acoustic waveguide and so that the waveguide radiates acoustic radiation from an open end of the waveguide; and the waveguide comprises a structure for increasing the amplitude of the acoustic radiation that is radiated from the open end of the waveguide. The structure for increasing the amplitude may comprise an acoustic volume, acoustically coupled to the acoustic waveguide. The acoustic waveguide may be substantially lossless. The acoustic waveguide may have curved walls forming walls of an acoustic volume acoustically coupled to the acoustic waveguide to increase the acoustic radiation from the waveguide. The acoustic waveguide walls may form walls of a teardrop shaped acoustic volume. The waveguide walls may form walls of another acoustic volume coupled to the acoustic waveguide. The loudspeaker assembly may further include electronic components positioned in the acoustic volume. The loudspeaker assembly may further comprise a coupling volume for acoustically coupling the acoustic waveguide to the acoustic volume; and the combination of the coupling volume and the acoustic volume may form a Helmholtz resonator having a Helmholtz resonance frequency that is outside the operating range of the loudspeaker assembly. The acoustic driver may be mounted so that a second surface of the acoustic driver radiates into the environment. The waveguide may comprise multiple curved sections substantially defining at least one acoustic volume, coupled to the acoustic waveguide. The acoustic waveguide may substantially define another acoustic volume, coupled to the acoustic waveguide. The acoustic volume may be teardrop shaped. The waveguide may have an effective acoustic length; the acoustic volume may have acoustic paths each having a length that is less than 10% of the effective acoustic length of the loudspeaker assembly, or each having a length that is greater than 10% of the effective acoustic length of the loudspeaker assembly and that is within a range of lengths that does not result in a dip in a frequency response. The acoustic volume may comprise a baffle structure causing the length of an acoustic path to be within the range of lengths. The waveguide may have a substantially constant cross-sectional area. The waveguide may have a cross sectional area at a closed end adjacent the acoustic driver than at an open end.

In another aspect, a loudspeaker apparatus comprises an acoustic waveguide and an acoustic driver having a first radiating surface and a second radiating surface, the acoustic driver mounted to the waveguide so that the first surface radiates acoustic energy into the acoustic waveguide so that the acoustic radiation is radiated from the waveguide. The loudspeaker apparatus may be characterized by a cancellation frequency at which radiation from the second surface is out of phase with the radiation from the waveguide, resulting in destructive interference between the radiation from the waveguide and the radiation from the second surface, resulting in a reduction in acoustic output from the loudspeaker apparatus at the cancellation frequency. The loudspeaker apparatus may have an acoustic volume, acoustically coupled to the waveguide to increase the amplitude of the radiation from the waveguide resulting in less reduction in acoustic output from the loudspeaker apparatus at the cancellation frequency.

Other features, objects, and advantages will become apparent from the following detailed description, when read in connection with the following drawing, in which:

DETAILED DESCRIPTION

Figure 1A:
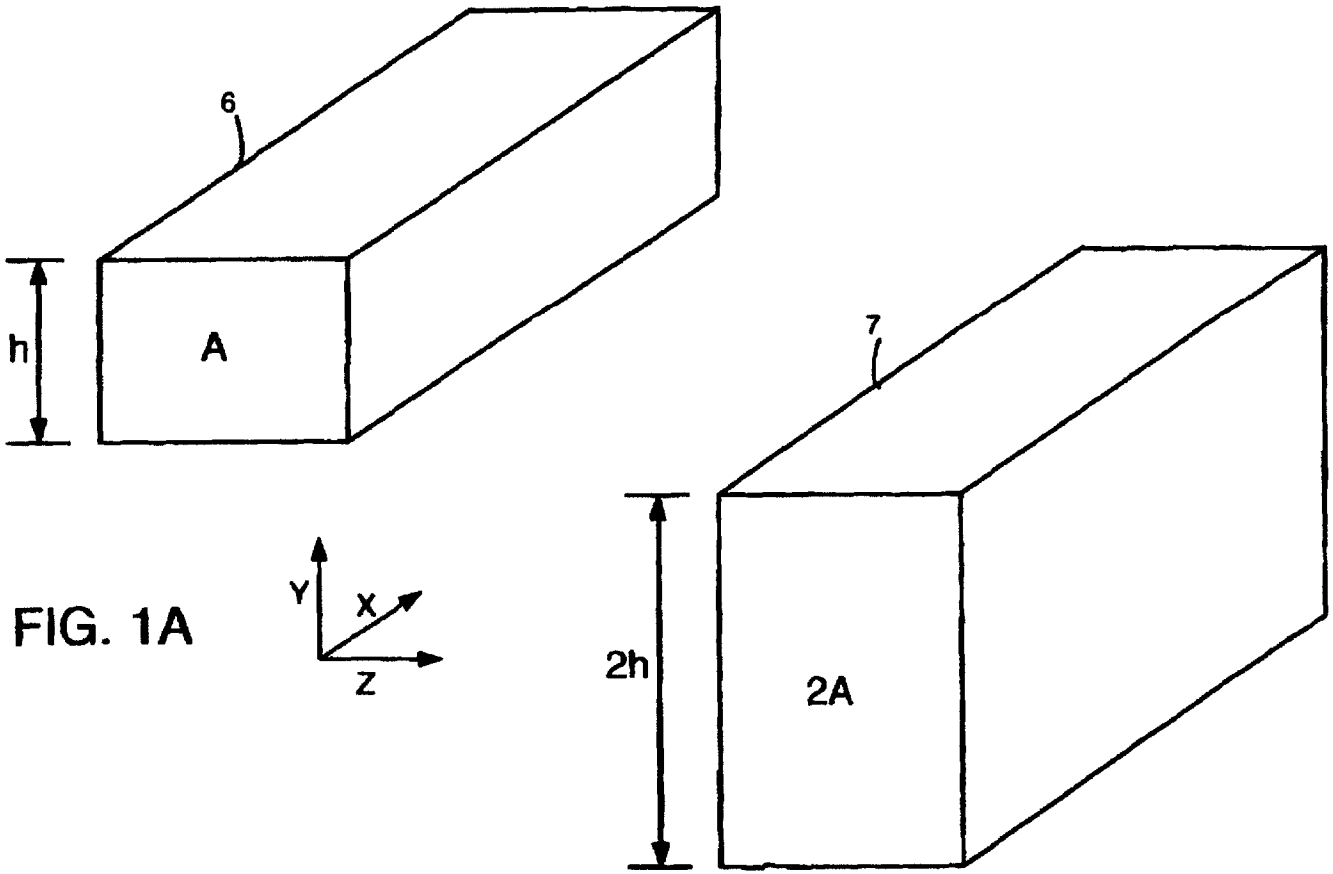
FIGS. 1A and 1B are geometric objects useful in understanding some of the other figures.
Figure 1B:
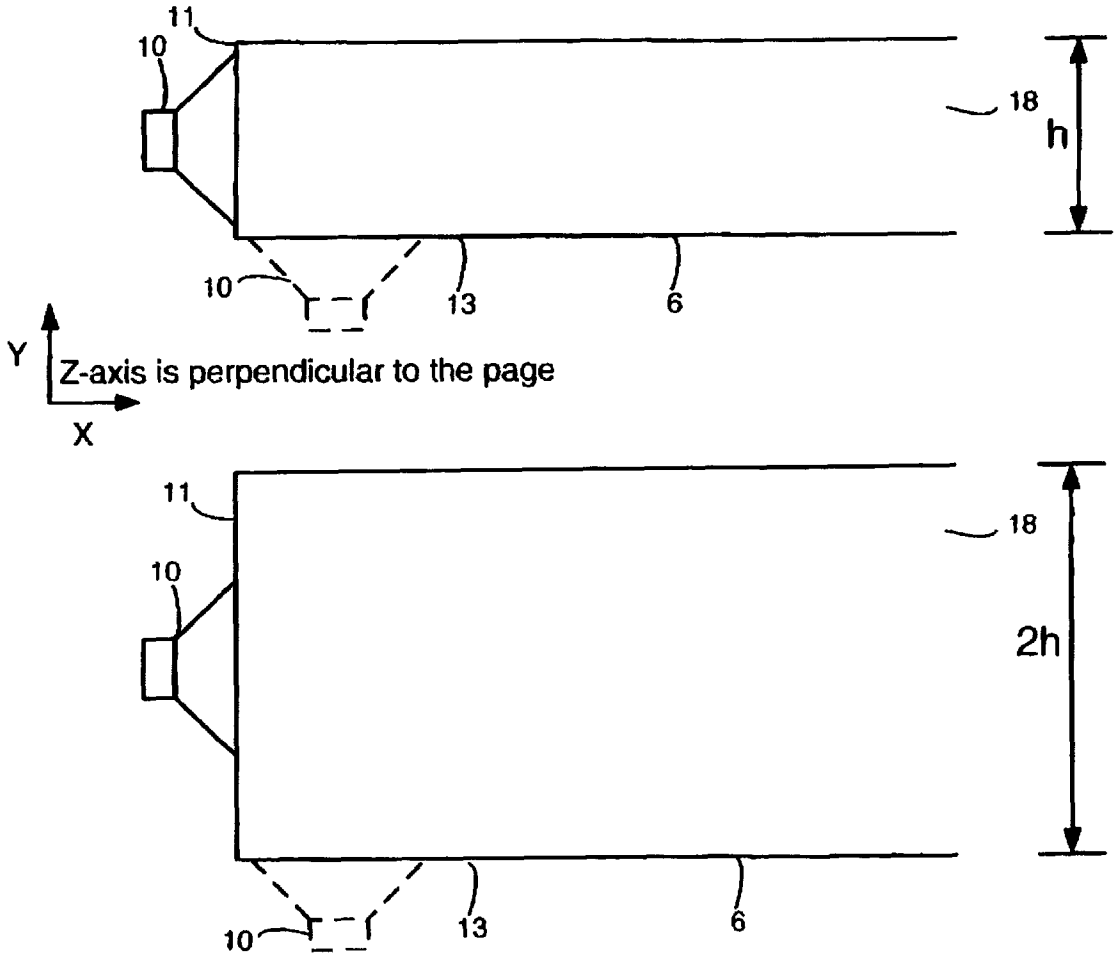

FIGS. 1A and 1B show some geometric objects useful in understanding some of the figures that follow. FIG. 1A is an isometric view of two waveguides 6 and 7. Waveguides 6 and 7 are depicted as structures having rectangular cross-sections in the Y-Z plane and an X-dimension longer than both the Y- and Z-dimensions. The area dimension in the Y-Z plane (hereinafter the "area dimension") of waveguide 6 is A and the linear dimension along the Y-axis is h. In the specification, there are references to changes in the area dimension. In the corresponding figures, changes to the area are depicted by changes in dimension in the Y-direction, holding the dimension in the Z-direction uniform. So for example, a waveguide 7 with an area dimension of 2A would be depicted in the corresponding figure by a doubling of the linear dimension h along the Y-axis to 2*h*. FIG. 1B shows the waveguides of FIG. 1A as cross sections in the X-Y plane and includes some additional elements. Except where otherwise specified, the waveguides in the following figures are shown as cross-sections in the X-Y plane, with the longest dimension in the X-dimension. Except where otherwise specified, "length" refers to the length of the acoustic path through the waveguide. Since waveguides are frequently bent or curved, the length may be greater than the X-dimension of a device incorporating the waveguide. Acoustic waveguides typically have at least one open end 18 and may have a closed end 11. An acoustic driver 10 is typically mounted in the closed end 11 as shown, but may be mounted in one of the walls 13 as represented by the dashed line. In the figures that follow, the acoustic driver is shown as mounted in closed end 11.

Figure 2:
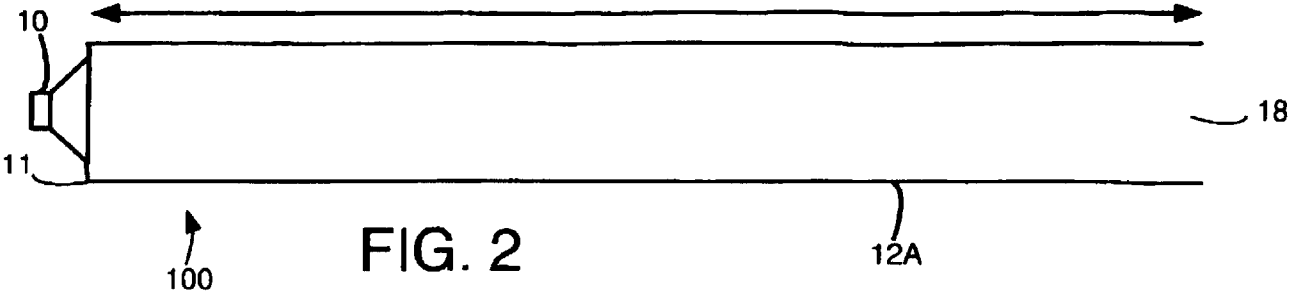
FIG. 2 is a diagrammatic view of a waveguide assembly.

FIG. 2 shows a first waveguide assembly 100. An acoustic driver 10 is mounted in one end of a waveguide 12A that is low loss and preferably substantially lossless through the frequency range of operation of the waveguide. The waveguide 12A has a cross-sectional area A and an effective acoustic length l. The waveguide has a tuning frequency which is determined principally by the effective acoustic length of the waveguide, which is the physical length plus end effect corrections. End effect corrections may be determined using estimation techniques or empirically. For simplicity, in the figures the length l will be shown as the physical length and the term "length" will refer to the effective acoustic length. The waveguide 12A has a volume given by lA.

Figure 3A:
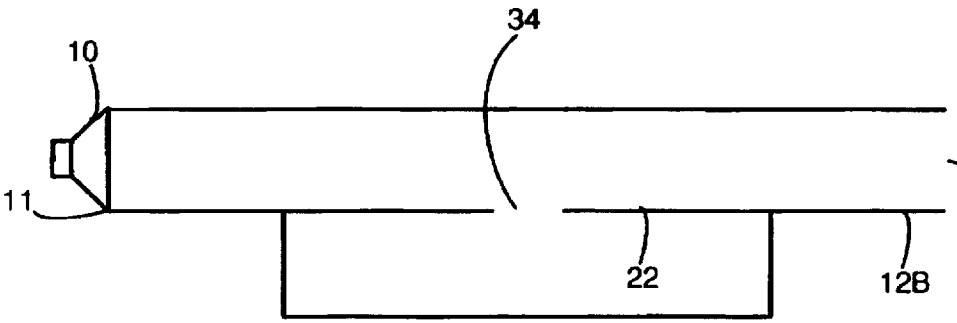
FIGS. 3A and 3B are diagrammatic views of waveguide assemblies.
Figure 3B:
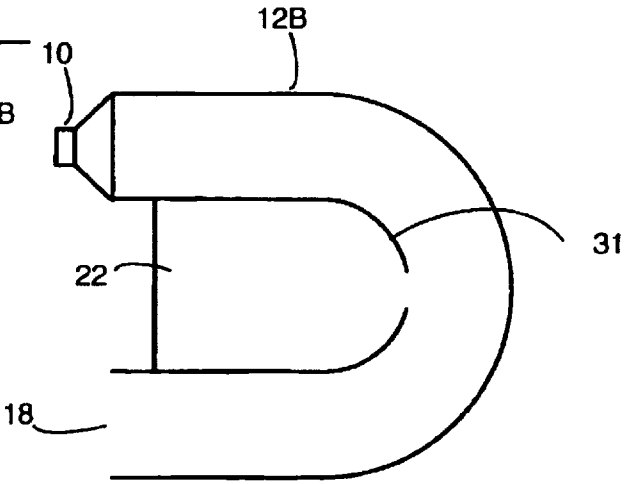

FIG. 3A shows a second waveguide assembly. An acoustic driver 10 is coupled to a waveguide 12B that is low loss and preferably substantially lossless through the frequency range of operation of the waveguide. Waveguide 12B has a physical length $\beta l$ and a cross-sectional area $\beta A$, where $\beta$ is a factor<1. The volume of the waveguide 12B is $\beta^2 lA$. Acoustically coupled by opening 34 to the waveguide 12B is an acoustic volume or chamber 22. The volume of the chamber 22 is $lA-\beta^2 lA$, so that the volume of the waveguide 12B plus the volume of the chamber 22 is the same as the volume of the waveguide 12A of FIG. 2. An effect of the chamber 22 is that the waveguide 12B has essentially the same tuning frequency as the waveguide 12A of FIG. 2 despite having a shorter length. An advantage of the waveguide of FIG. 3A is that (except as described below in the discussion of Helmholtz resonators and in the discussion of FIGS. 6A and 6B) the chamber 22 can be many shapes so long as the chamber 22 has the correct volume dimension. So, for example, as shown in FIG. 3B, the walls of chamber 22 can form a gradually curved surface 31 which forms the walls of the waveguide 12B. A waveguide having a gradual curve causes less turbulence and undesirable noise than waveguides with a more abrupt curve or change in direction and also use space efficiently. As long as the intended volume is maintained, the dimensions of chamber 22 may have a wide range of values, except as discussed below in the discussion of FIGS. 6A and 6B.

Figures 3C, 3D:
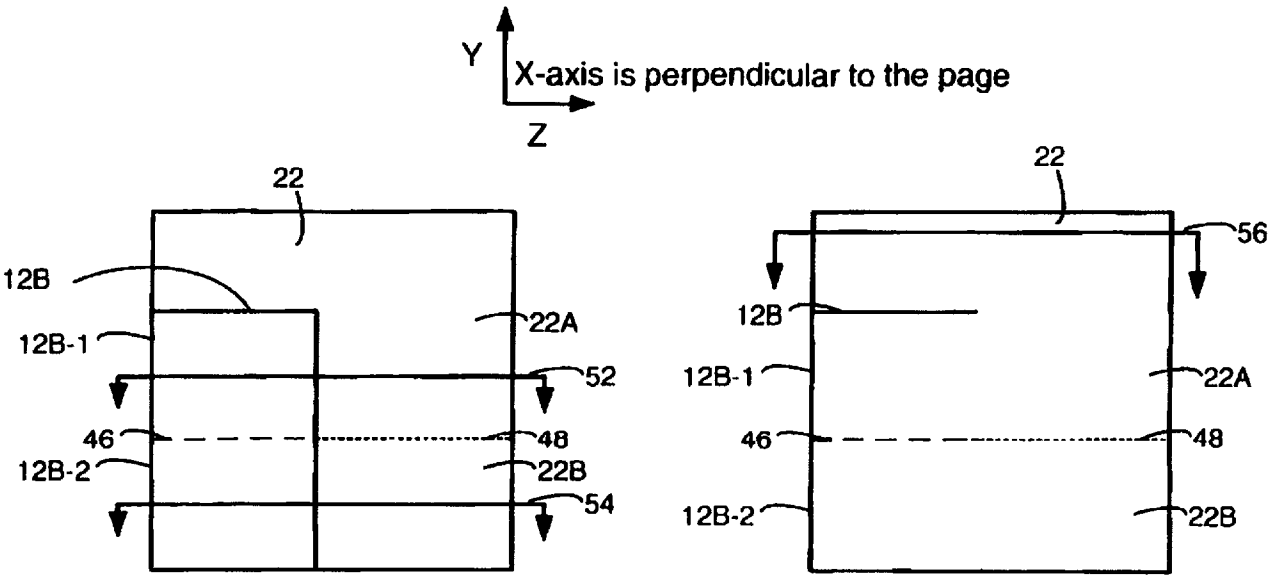
FIGS. 3C and 3D are diagrammatic cross-sectional views of waveguide assemblies.

FIGS. 3C and 3D show cross-sections of a waveguide assembly in the Y-Z plane, so that the x-dimension (the longest dimension of the waveguide) is perpendicular to the sheet of the drawing. In the waveguide of FIG. 3C, the chamber 22 has a dimension in the Y direction and the Z direction that is larger than the Y and Z dimension of the waveguide 12B so that the chamber partially or completely envelops the waveguide. If desired, for example for ease of manufacture, a barrier 46 or a barrier 48 or both may be placed in the waveguide 12B or the chamber, respectively (so that there are two waveguides 12B-1 and 12B-2 or two chambers 22A and 22B or both), and achieve the same acoustic result as if there were no barriers. Sight lines 52, 54, and 56 will be referenced below. To eliminate high frequency peaks, there may be a small amount of acoustically resistant material in accordance with U.S. Pat. No. 6,278,789 in the waveguide of FIG. 3A and in the waveguides of all subsequent figures.

Figure 4A:
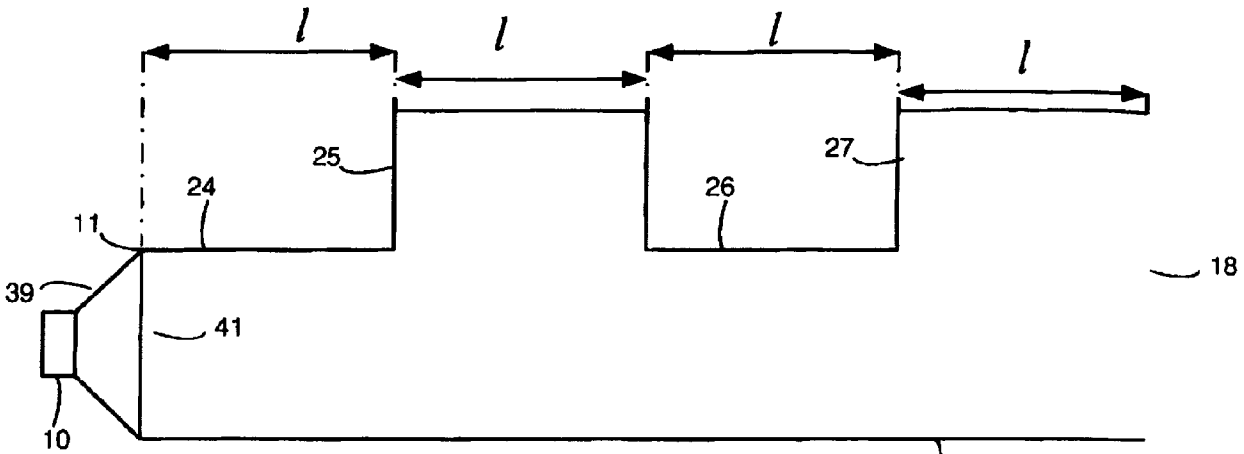
FIGS. 4A-4G are diagrammatic views of waveguide assemblies.

The concepts of reducing the cross-sectional area and length of a waveguide and adding a chamber to the waveguide as shown in FIGS. 3A and 3B can be applied to portions of waveguides, for example stepped portions of stepped waveguides, as well as whole waveguides, for example stepped waveguides. FIG. 4A shows a stepped waveguide 12C according to U.S. Pat. No. 6,771,787. An acoustic driver 10 is mounted in one end of the stepped waveguide 12C. The stepped waveguide 12C has four sections 24-27 along the length of the waveguide, with section 24 adjacent the acoustic driver and section 27 adjacent the open end 18 of the waveguide. The sections are of substantially equal length l. Section 24 has a cross sectional area $A_1$, section 25 has a cross sectional area $A_2$, which is larger than $A_1$; section 26 has a cross sectional area $A_3$, and section 27 has a cross sectional area $A_4$ which is larger than cross sectional area $A_3$. The volume $V_1$ of section 24 is $A_1 l$, the volume $V_2$ of section 25 is $A_2 l$, the volume $V_3$ of section 26 is $A_3 l$ and the volume $V_4$ of section 26 is $A_4 l$. In conventional waveguides, radiation from a surface of the acoustic driver that faces the environment (hereinafter the exterior surface) is out of phase with radiation from the surface of the acoustic driver that faces into the waveguide. At wavelengths equal to the effective acoustic length of the waveguide, the radiation from the waveguide and the radiation from the exterior surface of the waveguide destructively interfere, reducing the combined radiation of the waveguide and the acoustic driver. In a waveguide system according to FIG. 4A, the radiation from the waveguide is greater than the radiation from the exterior surface of the acoustic driver, and therefore the dip in the combined radiation from the waveguide and the exterior surface is eliminated. In one embodiment, the waveguide assembly of FIG. 4A, $A_1=A_3$, $A_2=A_4$, and $$\frac{A_1}{A_2}=\frac{A_3}{A_4}=\frac{1}{\sqrt{3}}.$$

The operation of the waveguide assembly of FIG. 4A is described in U.S. Pat. No. 6,711,787.

Figure 4B:
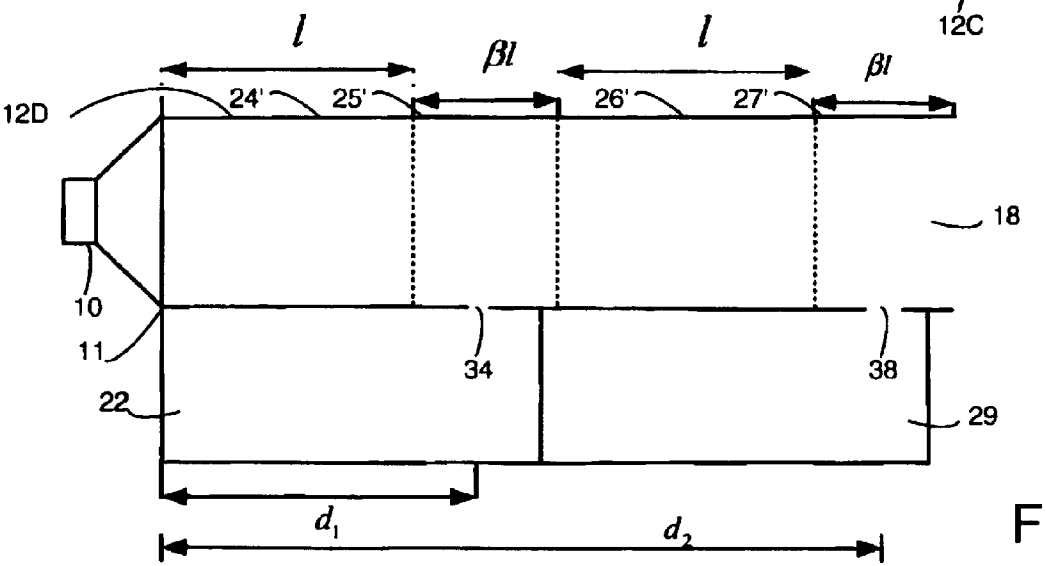

FIG. 4B illustrates a waveguide system using chambers acoustically coupled to the waveguide so that the waveguide is shorter than a corresponding conventional waveguide. An acoustic driver 10 is mounted in one end of a waveguide 12D. Waveguide 12D, and waveguides in the subsequent figures, is low loss and preferably substantially lossless through the frequency range of operation of the waveguide. The waveguide 12D has a cross sectional area equal to the cross sectional area $A_1$ of sections 24 and 26 of the waveguide of FIG. 4A. Sections 25 and 27 of FIG. 4A have been replaced by sections 25' and 27', respectively. Sections 25' and 27' have a length of $\beta l$ and a cross-sectional area $A'_2$ equal to $\beta A_2$ where $\beta$ is a number $0<k<1$. In this example, $$\beta=\frac{1}{\sqrt{3}},$$

so that the waveguide of FIG. 4B has a uniform cross-sectional area A throughout the length of the waveguide. Sections 24' and 26' have a cross-sectional area of A and volumes ($V_1$ and $V_3$ respectively) of lA. Sections 25' and section 27' have a cross-sectional area of $A'_2$ and volumes ($V'_2$ and $V'_4$ respectively) of $\beta^2A_2l$. At a distance $d_1$ (where $l<d_1<l+\beta l$, in one example $$d_1=l+\frac{\beta l}{2})$$

from the acoustic driver end of the waveguide, a chamber 22 is acoustically coupled to the waveguide through an opening 34. At a distance $d_2$ (where $l+\beta l+l<d_2<l+\beta l+\beta l+l+\beta l$, in one example $$d_2=l+\beta l+l+\frac{\beta l}{2})$$

from the acoustic driver end 11 of the waveguide, a chamber 29 is acoustically coupled to the waveguide through an opening 38. Chamber 22 has a volume dimension $V_c$ of $A_2l\,(1-\beta^2)$ so that $V'_2+V_c=V_2$, and chamber 29 has a volume dimension $V_D$ of $A_4l(1-\beta^2)$ so that $V'_4+V_c=V_4$, so that the total volume occupied by the assembly of FIG. 4B and the total volume occupied by the assembly of FIG. 4A are substantially equal. As stated above, so long as the chambers have the correct volume, the volume can have any shape, orientation, or linear dimensions of the chambers, except as shown below in FIGS. 6A and 6B and discussed in the corresponding portion of the specification.

The opening 34 or 38 may have an area such that it may form, with the chamber 22 or 29, respectively, a Helmholtz resonator which could have adverse acoustic effects on the operation of the waveguide system. Helmholtz resonators are described in, for example, http://www.phys.unsw.edu.au/jw/Helmholtz.html, a copy of which is attached as an appendix. However, the dimensions of the opening 34 and of the chamber 22 can be selected so that the Helmholtz resonance frequency is at a frequency that does not adversely affect the operation of the waveguide system or that is outside the operating frequency range of the waveguide. Selecting dimensions so that the Helmholtz resonance frequency is outside the operating frequency of the waveguide can be done by making the width of openings 34 and 38 to the chambers 22 and 29 respectively, close to (for example >50% of) the width of the chambers.

The tuning of the waveguide 12D of FIG. 4B is essentially the same as the tuning of the waveguide 12C of FIG. 4A. Sections 24' and 26' of FIG. 4B have the same effect on the tuning of the waveguide as sections 24 and 26 of FIG. 4A. Sections 25' and 27' of FIG. 4B have the same effect on the tuning of the waveguide as sections 25 and 27 of FIG. 4A, even though the physical length of sections 25' and 27' of FIG. 4B is $\beta l$ which (since $\beta<1$) is shorter than the physical length l of sections 25 and 27 of FIG. 1.

The figures disclosed above are merely illustrative and not exhaustive and many variations are possible. For example, the waveguide may have more than four sections; sections such as sections 25' and 27' may have different lengths; the volume dimensions of sections such as 25' and 27' may have different volume dimensions; the combined volume dimensions such as $V_3$ and $V_4$ may not be equal to $V_2$; and as will be seen below, different configurations of the chambers are possible (for example, there may be different numbers of chambers, and the chambers may have different volume dimensions, shapes, and placements along the waveguide as will be described below).

In addition to providing the same tuning frequency with a waveguide of shorter length, the waveguide system of FIG. 4B has the same advantage of FIG. 4A with regard to eliminating the dip in the combined output of the acoustic driver and the waveguide at frequencies at which the corresponding wavelength equals the effective length of the waveguide. At these frequencies, the acoustic output of the waveguide is greater than the acoustic output radiated directly to the environment by acoustic driver, so the combined radiation from the waveguide and the acoustic driver is greater than the combined output from a conventional waveguide system. The waveguide assembly of FIG. 4B is also less prone than the waveguide assembly of FIG. 4A to wind noises that can occur at abrupt area discontinuities.

Figure 4C:
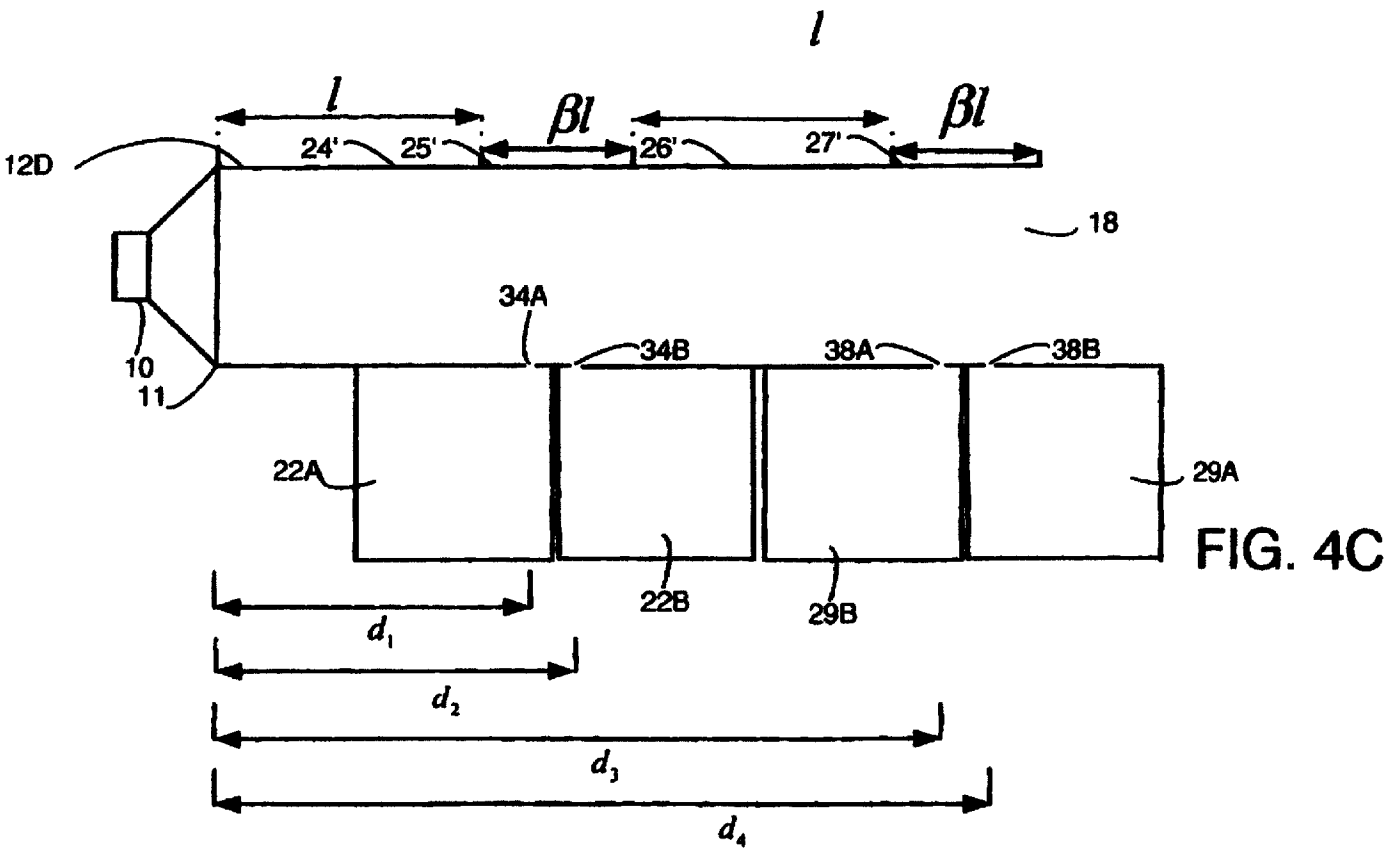

FIG. 4C shows a variation of the waveguide assembly of FIG. 4B. In the waveguide assembly of FIG. 4C, the chamber 22 of FIG. 4B is replaced by chambers 22A and 22B with a total volume equal to the volume of chamber 22. The entrance to chamber 22A is placed at distance $d_1$ such that $$l<d_1<l+\frac{\beta l}{2}$$

from the acoustic driver, in one example $$d_1=l+\frac{\beta l}{4}$$

and the entrance 34B to chamber 22B is placed at distance $d_2$ such that $$l+\frac{\beta l}{2}<d_2<l+\beta l$$

from the acoustic driver, in one example $$d_1=l+\frac{3\beta l}{4}.$$

Chamber 29 of FIG. 4B is replaced by chambers 29A and 29B with a total volume equal to the volume of chamber 29. The entrance 38A to chamber 29A is placed at distance $d_3$ such that $$l+\beta l+l<d_3<l+\beta l+l+\frac{\beta l}{2}$$

from the acoustic driver, in one example $$d_3=l+\beta l+l+\frac{\beta l}{4}$$

and the entrance 38B to chamber 29B is placed at distance $d_4$ such that $$l+\beta l+l+\frac{\beta l}{2}<d_4<l+\beta l+\beta l+l+\beta l$$

from the acoustic driver, in one example $$d_4=l+\chi l+l+\frac{3\beta l}{4}.$$

The effect of the tuning of the waveguide assembly of chambers 22A and 22B is substantially the same as the effect of chamber 22 of FIG. 4B, and the effect of on the tuning of the waveguide assembly of chambers 29A and 29B substantially is the same as the effect of chamber 26 of FIG. 4B and have the same beneficial effect of alleviating the dip in the output of the waveguide assembly at the frequency at which the wavelength equals the effective length of the waveguide. Generally, using multiple chambers permits the tuning frequency to more closely match the tuning frequency of the equivalent stepped waveguide such as the waveguide of FIG. 4A.

Figure 4D:
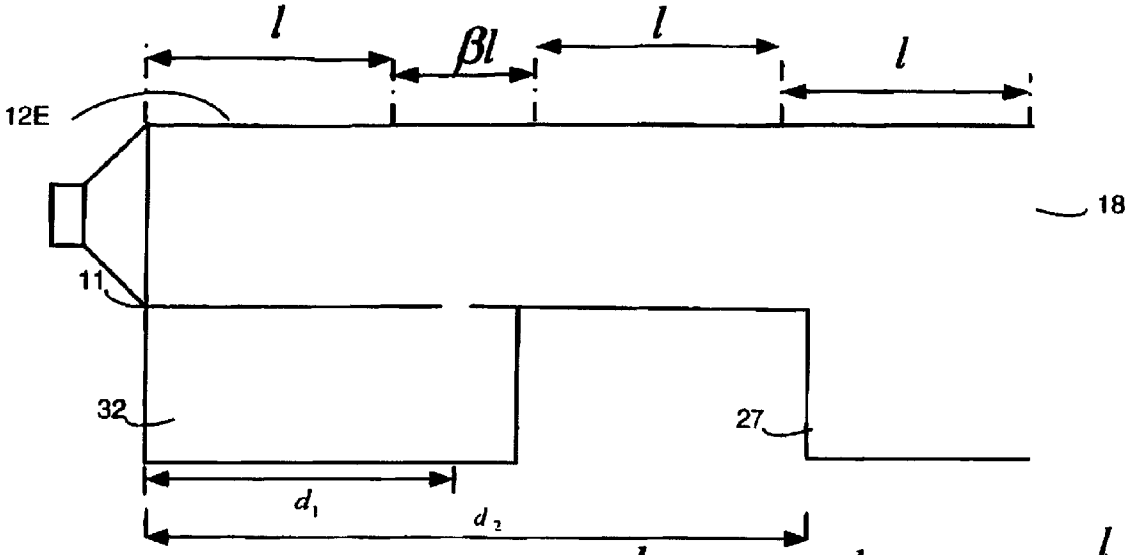
Figure 4E:
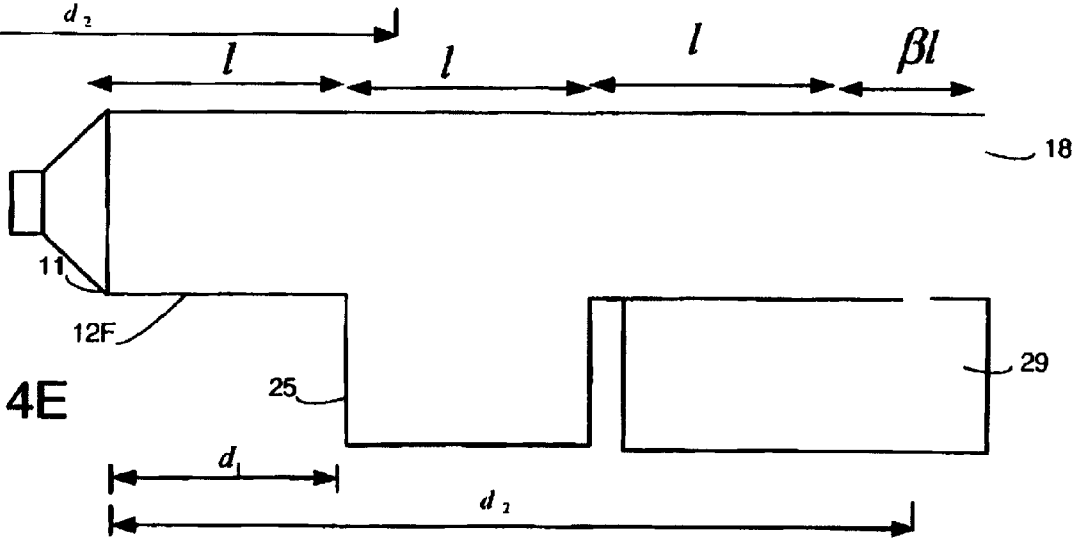
Figure 4F:
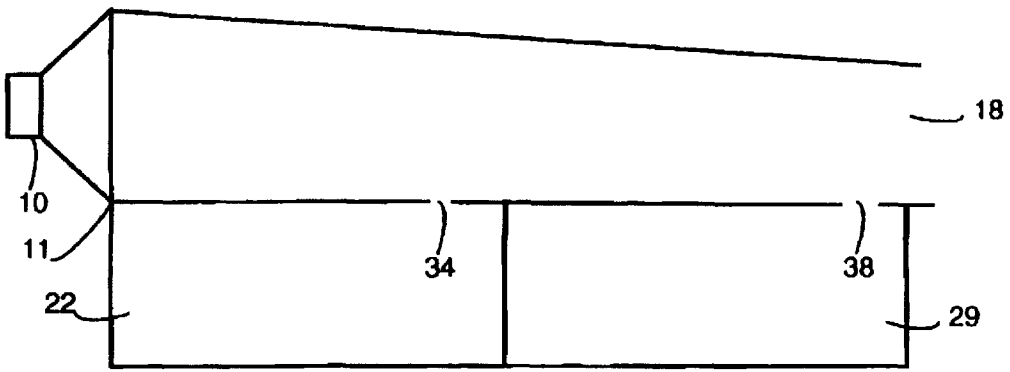
Figure 4G:
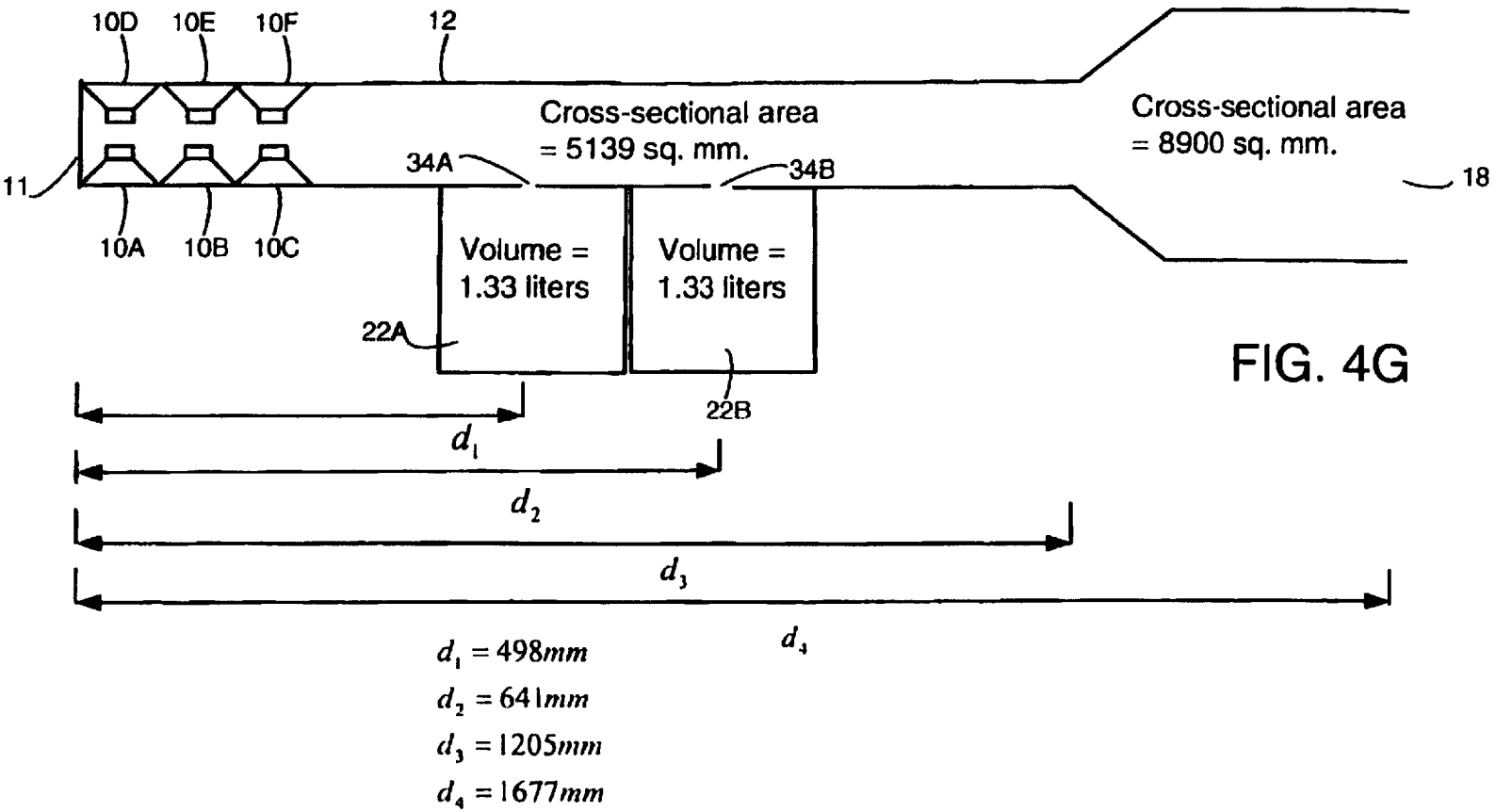

Aspects of FIGS. 4A, 4B, and 4C can be combined. For example, the waveguide assembly of FIG. 4D has a chamber 32 coupled to the waveguide 12E in the first section at distance $d_1$, where $l<d_1<l+\beta l$ and a stepped section 27 beginning at distance $d_2=l+\beta l+l$. The waveguide assembly of FIG. 4E has a waveguide 12F with a stepped section 25 beginning at distance $d_1=l$ and a chamber 29 at a distance $d_2>l+l+l$. Aspects of FIGS. 4A, 4B, and 4C can also be implemented in a tapered waveguide if the type shown in FIG. 1 of U.S. Pat. No. 6,771,787, as shown in FIG. 4F. For use in a tapered waveguide, the size of the chambers and the location of the openings from the waveguide to the chambers may be determined by modeling. A waveguide such as the waveguide with substantially continuous walls such as the waveguide of FIG. 4F may be less subject to wind noises that may occur at abrupt area discontinuities. The waveguide assembly of FIG. 4G is a diagrammatic view of a practical waveguide assembly incorporating elements of FIGS. 4A-4E. The implementation of FIG. 4G has six 2.25 inch acoustic drivers 10A-10F and dimensions as shown.

Figure 5B:
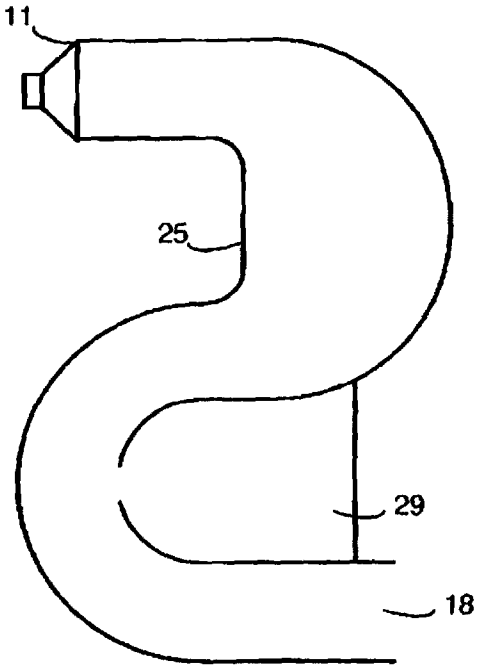
FIGS. 5A and 5B are diagrammatic views of a waveguide assembly.
Figure 5A:
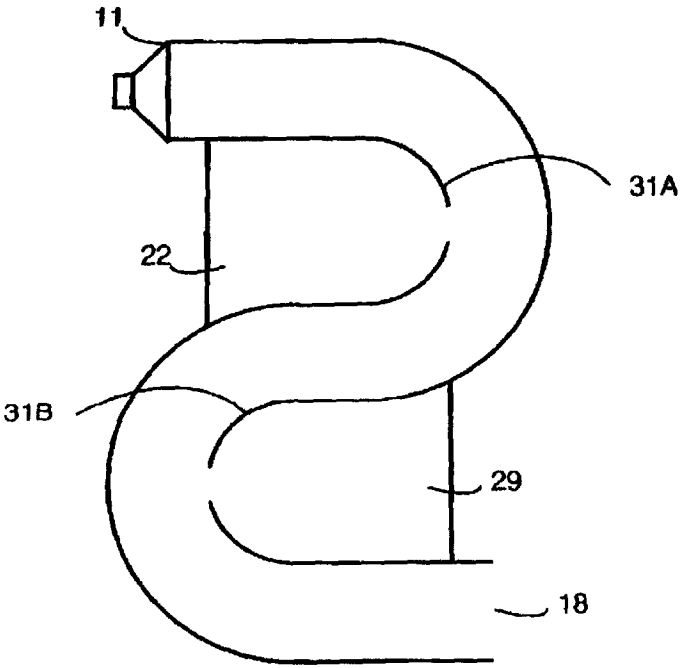

FIG. 5A shows an implementation of the waveguide assembly shown schematically in FIG. 4B illustrating walls of chambers 22 and 29 forming multiple curved surfaces 31A and 31B which also forms walls of the waveguide resulting in less turbulence than would occur with a more abrupt curve, while using space efficiently. The reference numbers in FIG. 5A indicate similarly numbered elements in the corresponding waveguide system of FIG. 4B. FIG. 5B shows an implementation of the waveguide shown schematically in FIG. 4E illustrating walls of chamber 29 and stepped section 25. The reference numbers in FIG. 5B indicate similarly numbered elements in the corresponding waveguide system of FIG. 4E.

Figure 6A:
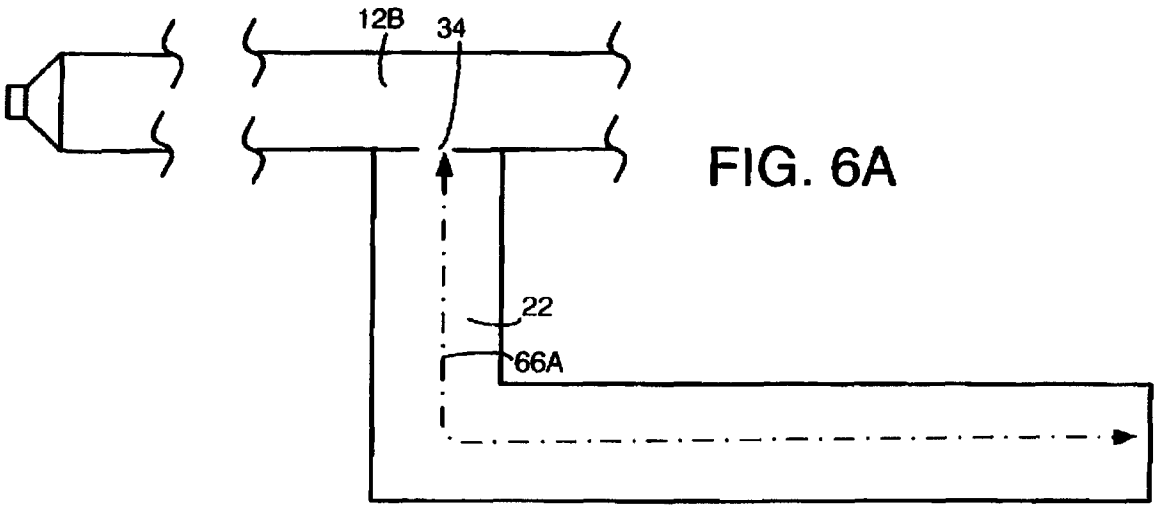
FIGS. 6A and 6B are diagrammatic views of a portion of a waveguide assembly.
Figure 6B:
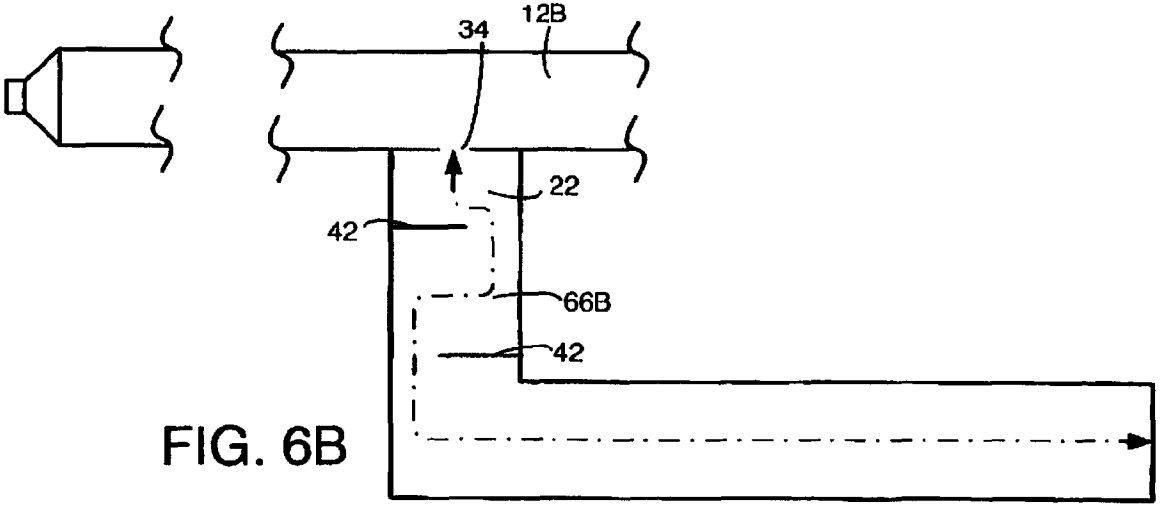

FIGS. 6A and 6B illustrate another feature of a waveguide assembly. In FIG. 6A, waveguide 12B is acoustically coupled to a chamber 22 through an opening 34. Acoustic waves enter the opening 34 and propagate into the chamber 22 along a number of acoustic paths, for example path 66A until the acoustic waves encounter an acoustic boundary. There may be many acoustic paths along which the acoustic waves propagate; for simplicity only one is shown.

Generally, it is desirable to configure the chamber so that the lengths of all acoustic paths are significantly shorter than one-fourth of the effective acoustic length of the waveguide 12B. If the length of one of the acoustic paths is not significantly shorter than one fourth (for example, not shorter than 10%) of the effective acoustic length of the waveguide, output dips may occur at certain frequencies. In one example, a waveguide assembly similar to waveguide assembly of FIG. 4B is tuned to 44 Hz, so that it has an effective acoustic length of 1.96 m. (6.43 feet). A chamber 22 with a volume of 1851.1 cc (114 cubic inches) is coupled to waveguide 12B at a position 39.6 cm (15.6 inches) from the closed end 11. Chamber 22 has an acoustic path 66A (see FIG. 6A) that has a length of 40.6 cm (16 inches), that is $$\frac{40.6\text{ cm}}{1.96\text{ m}}\times 100=20.7\%$$

of the effective acoustic length of the waveguide assembly. An undesirable dip in the frequency response may occur at about 200 Hz. Depending on factors such as the distance of the chamber 22 from the closed end 11, the dip in the frequency response may occur when the length of acoustic path 66A is as short as 25.4 cm (10 inches), which is $$\frac{25.4\text{ cm}}{1.96\text{ m}}\times 100=13.0\%$$

of the effective acoustic length of waveguide 12B.

One way of eliminating the frequency response dip is to reconfigure chamber 22 so that acoustic path 66A has a length shorter than 10% (in this case 19.6 cm) of the effective acoustic length of the waveguide system. However in a practical waveguide, it may be difficult to reconfigure the chamber so that acoustic path 66A has a length of less than 10% of the effective acoustic length of the waveguide system.

Another way of eliminating the frequency response dip is to add structure to the chamber 22 that changes the length of an acoustic path such as 66A to a length that does not cause a frequency response dip. FIG. 6B shows the waveguide system of FIG. 6A with baffles 42 inserted into the chamber so that the length of acoustic path 66B is 50.8±1.3 cm (20±0.5 inches). The waveguide system of FIG. 6B does not have the frequency response dip of the waveguide system of FIG. 6A. The path length dimensions at which dips may occur and the range of path lengths at which dips do not occur, and the variance of the path length with regard to the placement of the chamber opening relative to the ends of the waveguide can be determined by modeling or experimentation. If the situation shown in FIGS. 6A and 6B occurs, it is generally desirable to shorten the path length because the tolerance (the range of path lengths that result in no dip) is wider. In the example above, any length shorter than 25.4 cm is suitable, but the tolerance of the longer acoustic path is only ±1.3 cm.

Figure 7A:
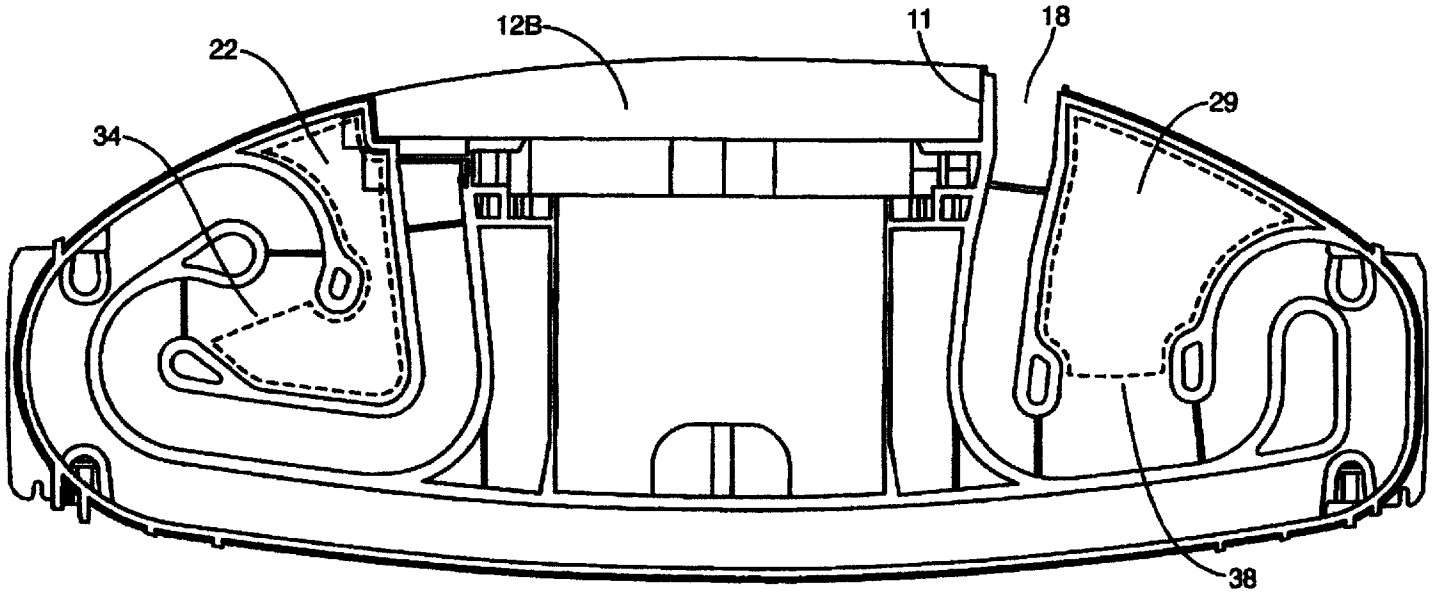
FIGS. 7A-7D are drawings of a practical implementation of loudspeaker systems with waveguide assemblies including features shown diagrammatically in other figures.
Figure 7B:
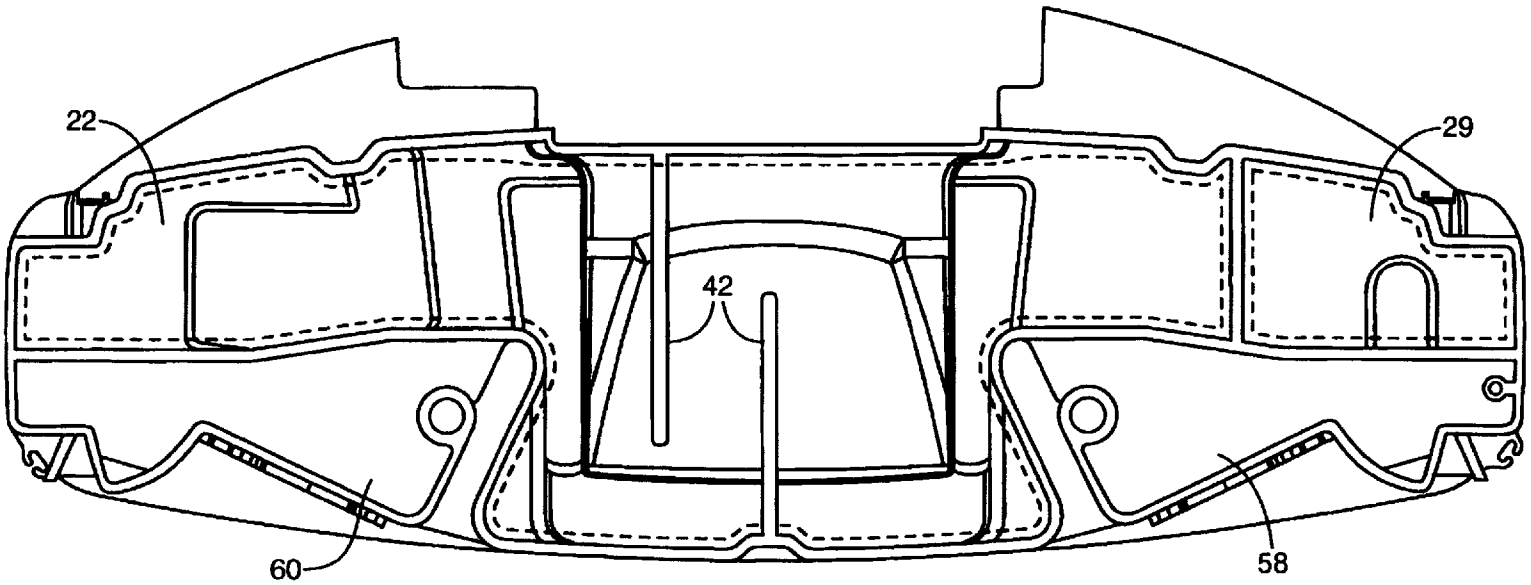

FIGS. 7A and 7B show a practical implementation of an audio reproduction device incorporating a waveguide assembly having features shown diagrammatically in previous figures. The elements in FIGS. 7A and 7B correspond to similarly numbered elements in the previous figures. The dashed lines in FIGS. 7A and 7B illustrate the boundaries of the chambers 22 and 29. FIG. 7A is a cross section in the X-Z plane of the audio reproduction device. The waveguide assembly 12B has the form of the waveguide assembly of FIG. 3C and the cross section is taken along a sight line corresponding to sight line 52 or 54 of FIG. 3C; the cross sections taken along sight lines corresponding to sight lines 52 and 54 are substantially identical. There is a barrier 46 (of FIG. 3C, not shown in this view) resulting in the waveguide assembly having two waveguides. FIG. 7B is a cross section in the X-Z plane, taken along a sight line corresponding to sight line 56 of FIG. 3C. The acoustic driver 10 (of previous figures), not shown in this view is coupled to the waveguide 12B. Compartments 58 and 60 are for high frequency acoustic drivers (not shown), which are not germane to the waveguide assembly. In the implementation of FIGS. 7A and 7B, volume $V_1$ of chamber 22 is about 1861 $cm^3$ (114 cubic inches); the volume $V_2$ of chamber 29 is about 836 $cm^3$ (51 cubic inches); the physical length of the waveguide is about 132.1 cm (52 inches); the center of opening 34 to chamber 22 is located about 39.6 cm (15.6 inches) from closed end 11 and the width of opening 34 is about 3.8 cm (1.5 inches); the center of opening 38 to chamber 29 is about 11.7 cm (4.6 inches) from the open end 18 of the waveguide and the width of opening 38 is about 3.8 cm (1.5 inches); and the waveguide is tuned to about 44 Hz.

Figure 7C:
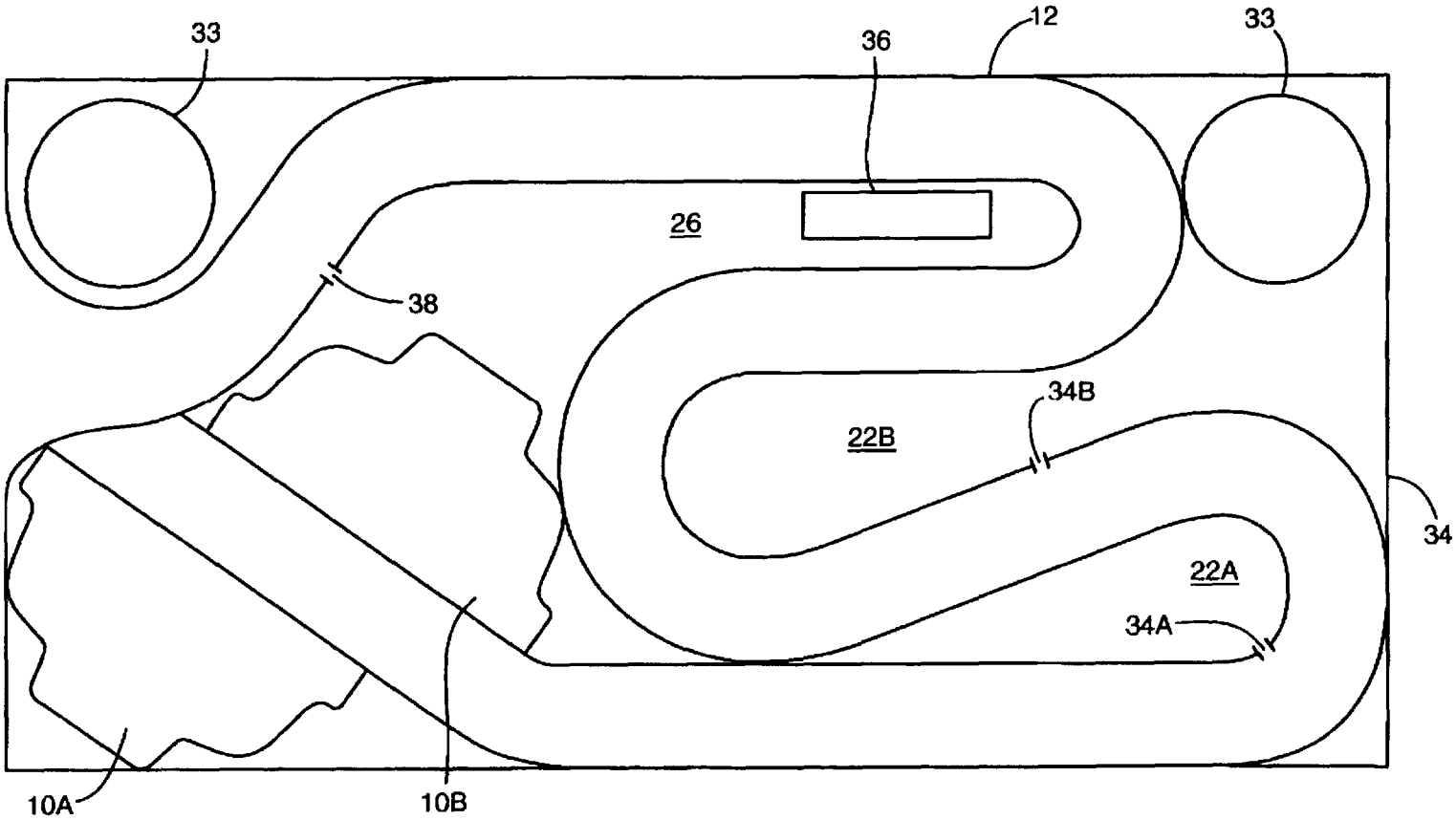

The waveguide assembly of FIG. 7C has two low frequency acoustic drivers 10A and 10B. The elements in FIG. 7C correspond to similarly reference numbered elements in the previous figures. The second section of the waveguide 12 has coupled to it two chambers 22A and 22B by openings 34A and 34B, respectively. The fourth section of the waveguide 12 has coupled to it a single chamber 26 by opening 38. The walls of the waveguide 12 form walls (which for the purposes of this application includes following substantially the same outline as the walls) of chambers 22A and 22B and substantially enclose chambers 22A and 22B. Chambers 22A and 22B are "teardrop" shaped to provide large turning radii for the waveguide, providing a lessening of turbulence than would occur with smaller turning radii or with sharp bends. Chamber 26 provides a large chamber with low air velocity that provides a convenient location for electronics components 36. The low velocity air causes less turbulence when it encounters the electronics 36. The irregular, multiply curved shape of chamber 26 permits the assembly to be fit efficiently into a small device enclosure 34. High frequency acoustic drivers do not radiate into the waveguide 12.

Figure 7D:
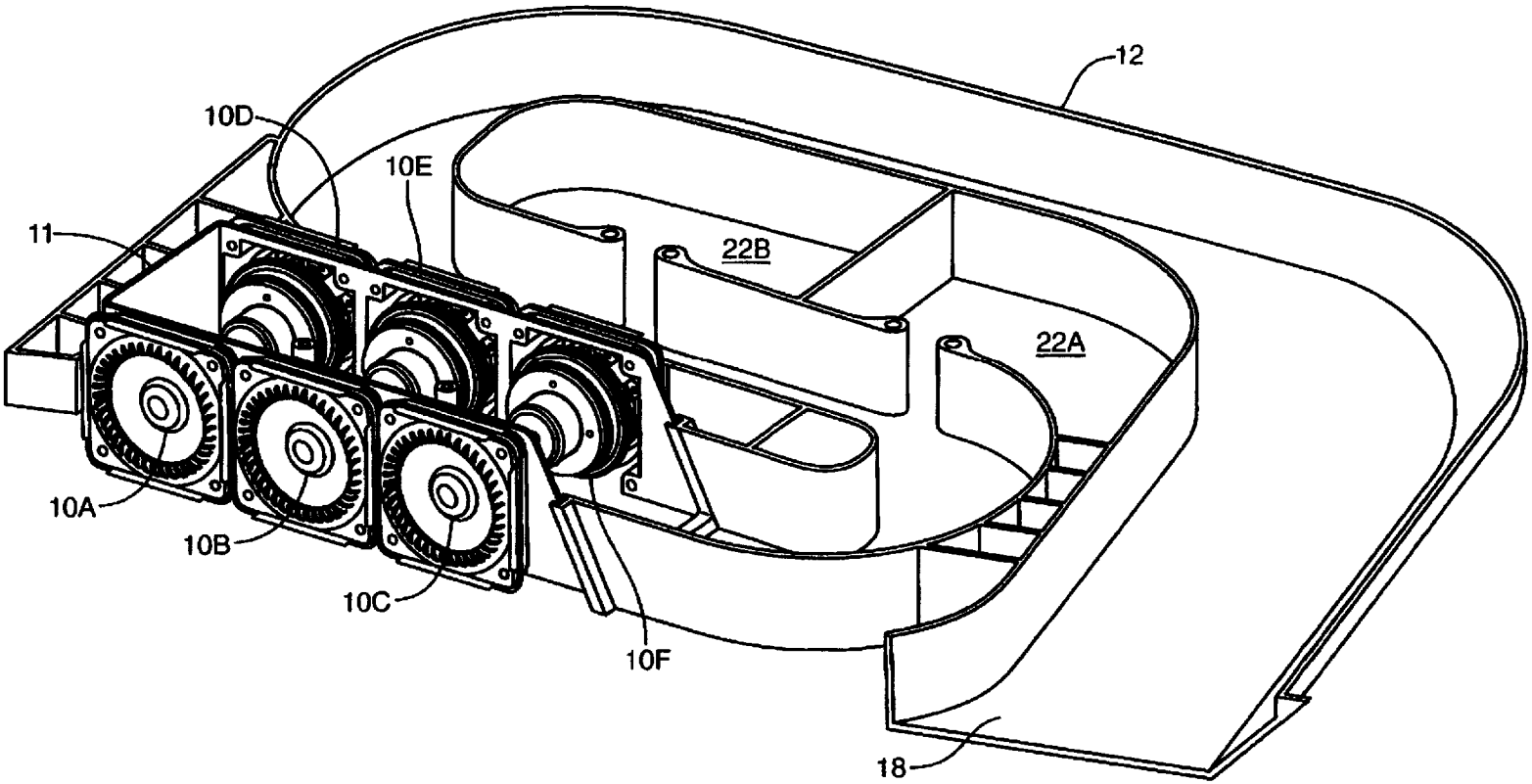

The waveguide assembly of FIG. 7D is a practical implementation of the waveguide illustrated schematically in FIG. 4F. The elements of FIG. 7D correspond to similarly reference numbers in FIG. 4F.

Figure 8:
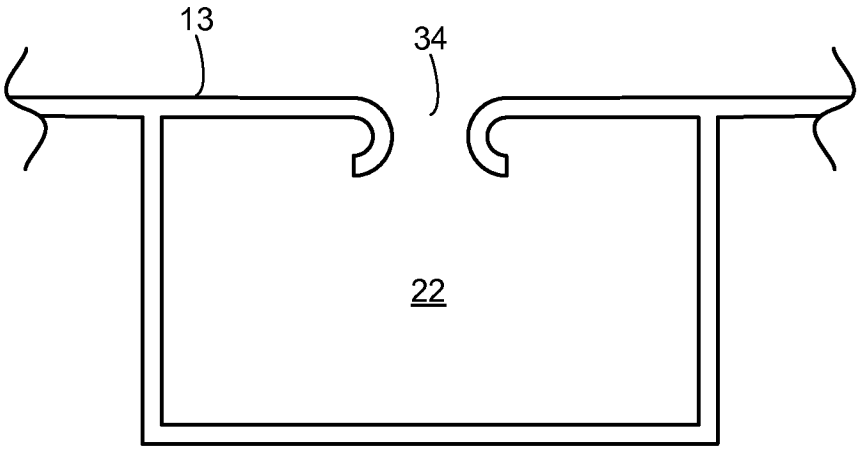
FIG. 8 is a diagrammatic view of a portion of a waveguide wall, an opening and an acoustic volume.

FIG. 8 shows an enlarged view of an implementation of the opening 34 and the chamber 22. The size of the opening 34 is intentionally greatly exaggerated for purposes of explanation. The opening 34 is formed by a portion of the walls bent inwardly toward the volume. Similar to the implementations of FIGS. 7A, 7B, and 7D, the opening 34 is configured so that the wall 13 and the opening 34 form a continuous surface; that is, there are no discontinuities such as a right angle between the opening and the wall. An opening configured as in FIGS. 7A, 7B, 7D, and 8 is advantageous because the continuous, smooth configuration of the opening causes less turbulence than an opening that is, for example, a right angle relative to the opening.

Other embodiments are in the claims.

What is claimed is:

1. A loudspeaker assembly, comprising:

an acoustic waveguide;

an acoustic driver mounted to the waveguide so that a first surface radiates sound waves into the waveguide so that the sound waves are radiated from the waveguide and so that a second surface radiates sound waves to the environment through a path that does not include the waveguide; and a closed acoustic volume acoustically coupled to the acoustic waveguide by an opening in the waveguide, wherein the wall and the opening comprise a continuous surface; and wherein the opening and the acoustic volume are dimensioned and positioned to increase the amplitude of the sound waves radiated from the acoustic waveguide at a wavelength at which radiation from the waveguide and radiation from the second surface of the acoustic driver destructively interfere.

2. A loudspeaker assembly according to claim 1, wherein the acoustic waveguide is substantially lossless.

3. A loudspeaker assembly according to claim 1, wherein the acoustic volume is dimensioned and positioned to increase the amplitude of sound waves radiated from the waveguide of a wavelength equal to the effective acoustic length of the waveguide.

4. A loudspeaker assembly according to claim 1, the acoustic waveguide having curved walls forming walls of the acoustic volume.

5. A loudspeaker assembly according to claim 4, wherein the acoustic volume is tear drop shaped.

6. A loudspeaker assembly according to claim 4, the waveguide walls forming walls of another closed acoustic volume coupled to the acoustic waveguide.

7. A loudspeaker assembly in accordance with claim 1, wherein the opening forms a coupling volume, the combination of the coupling volume and the acoustic volume forming a Helmholtz resonator having a Helmholtz resonance frequency that is outside the operating range of the waveguide.

8. A loudspeaker assembly according to claim 1, wherein the acoustic driver is mounted so that a second surface of the acoustic driver radiates directly to the environment.

9. A loudspeaker assembly according to claim 1, the acoustic volume comprising a baffle structure.

10. A loudspeaker assembly according to claim 1, the waveguide having a substantially constant cross-sectional area.

11. A loudspeaker assembly according to claim 1, wherein a closed end of the waveguide adjacent the acoustic driver has a larger cross-sectional area than an open end of the waveguide.

12. A loudspeaker according to claim 1, wherein in the opening comprises a portion of the wall bent inwardly toward the acoustic volume.

13. A loudspeaker assembly, comprising:

an acoustic driver;

an acoustic waveguide with substantially continuous walls acoustically coupled to the acoustic driver so that a first surface of the acoustic driver radiates into the acoustic waveguide and so that the waveguide radiates acoustic radiation from an open end of the waveguide and so that a second surface radiates sound waves to the environment through a path that does not include the waveguide, the waveguide comprising a closed acoustic volume, acoustically coupled to the acoustic waveguide by an opening, wherein the opening and a wall of the waveguide comprise a continuous surface, and wherein the opening is positioned and the acoustic volume is dimensioned to increase the amplitude of the acoustic radiation that is radiated from the open end of the waveguide at a wavelength at which radiation from the waveguide and radiation from the second surface of the acoustic driver destructively interfere.

14. A loudspeaker assembly according to claim 13, wherein the acoustic waveguide is substantially lossless.

15. A loudspeaker assembly in accordance with claim 13, the structure dimensioned and positioned to increase the amplitude of the acoustic radiation that is radiated from the open end of the waveguide at a wavelength at which radiation from the waveguide and radiation from the second surface of the acoustic driver destructively interfere, the combination of the coupling volume and the acoustic volume forming a Helmholtz resonator having a Helmholtz resonance frequency that is outside the operating range of the waveguide.

16. A loudspeaker assembly according to claim 13, wherein the acoustic driver is mounted so that a second surface of the acoustic driver radiates directly to the environment.

17. A loudspeaker assembly according to claim 13, wherein a closed end of the waveguide adjacent the acoustic driver has a cross sectional area than at an open end of the waveguide.

18. A loudspeaker assembly according to claim 13, wherein the opening comprises a portion of the wall bent inwardly toward the acoustic volume.

19. A loudspeaker apparatus comprising:

an acoustic waveguide;

an acoustic driver having a first radiating surface and a second radiating surface, the acoustic driver mounted to the waveguide so that the first surface radiates acoustic energy into the acoustic waveguide so that the acoustic radiation is radiated from the waveguide;

the loudspeaker apparatus characterized by a cancellation frequency at which radiation from the second surface is out of phase with the radiation from the waveguide, resulting in destructive interference between the radiation from the waveguide and the radiation from the second surface, resulting in a reduction in acoustic output from the loudspeaker apparatus at the cancellation frequency; and a closed acoustic volume, acoustically coupled to the waveguide by an opening in the waveguide, wherein the opening and a wall of the waveguide comprise a continuous surface, and wherein the opening and the acoustic volume are dimensioned and positioned to increase the amplitude of the radiation from the waveguide resulting in less reduction in acoustic output from the loudspeaker apparatus at the cancellation frequency.

20. A loudspeaker according to claim 19, wherein the opening comprises a portion of the wall bent inwardly toward the acoustic volume.

* * * * *

UNITED STATES PATENT AND TRADEMARK OFFICE

CERTIFICATE OF CORRECTION

PATENT NO. : 8,615,097 B2
APPLICATION NO. : 13/630319
DATED : December 24, 2013
INVENTOR(S) : Robert Preston Parker et al.

It is certified that error appears in the above-identified patent and that said Letters Patent is hereby corrected as shown below:

On the Title Page

Item (71), Applicants:

Delete "Robert Preston Parker, Westborough, MA (US); Eric J. Freeman, Sutton, MA (US); Jeffrey J. Hoefler, Westwood, MA (US)" and replace with "Bose Corporation, Framingham, MA (US)".

Signed and Sealed this
Fourteenth Day of October, 2014

Michelle K. Lee

Michelle K. Lee
*Deputy Director of the United States Patent and Trademark Office*